US011248783B2

(12) United States Patent
Huang et al.

(10) Patent No.: US 11,248,783 B2
(45) Date of Patent: Feb. 15, 2022

(54) LIGHTING APPARATUS

(71) Applicant: XIAMEN ECO LIGHTING CO. LTD., Xiamen (CN)

(72) Inventors: Xiaojuan Huang, Xiamen (CN); Qingguang Zeng, Xiamen (CN); Qiongqiao Zhang, Xiamen (CN); Maojin Zeng, Xiamen (CN); Lianwei Zhang, Xiamen (CN)

(73) Assignee: XIAMEN ECO LIGHTING CO. LTD., Fujian (CN)

( * ) Notice: Subject to any disclaimer, the term of this patent is extended or adjusted under 35 U.S.C. 154(b) by 0 days.

(21) Appl. No.: 16/852,467

(22) Filed: Apr. 18, 2020

(65) Prior Publication Data

US 2021/0325028 A1 Oct. 21, 2021

(51) Int. Cl.

| | |
|---|---|
| ***F21V 29/67*** | (2015.01) |
| ***F21V 29/74*** | (2015.01) |
| ***F21V 19/00*** | (2006.01) |
| ***F21V 23/06*** | (2006.01) |
| ***F21S 8/02*** | (2006.01) |
| ***F21V 23/00*** | (2015.01) |
| *F21Y 115/10* | (2016.01) |

(52) U.S. Cl.

CPC ..... *F21V 29/677* (2015.01); *F21S 8/026* (2013.01); *F21V 19/0035* (2013.01); *F21V 23/001* (2013.01); *F21V 23/06* (2013.01); *F21V 29/74* (2015.01); *F21Y 2115/10* (2016.08)

(58) Field of Classification Search

CPC ..... F21V 29/677; F21S 8/026

See application file for complete search history.

(56) References Cited

U.S. PATENT DOCUMENTS

| | | | | |
|---|---|---|---|---|
| 3,691,365 | A * | 9/1972 | Sequerra | F21V 19/02 362/6 |
| 8,405,947 | B1 * | 3/2013 | Green | F21V 25/10 361/103 |
| 9,052,081 | B1 * | 6/2015 | Paulsel | F21V 7/00 |
| 2008/0165535 | A1 * | 7/2008 | Mazzochette | F21V 7/041 362/294 |
| 2008/0198583 | A1 * | 8/2008 | McMillen | H04R 1/028 362/147 |
| 2011/0074265 | A1 * | 3/2011 | Van De Ven | F21S 8/02 313/46 |
| 2012/0218760 | A1 * | 8/2012 | Nagaoka | F21V 17/12 362/249.02 |

(Continued)

*Primary Examiner* — Bryon T Gyllstrom
*Assistant Examiner* — Christopher E Dunay
(74) *Attorney, Agent, or Firm* — Chun-Ming Shih; Lanway IPR Services

(57) ABSTRACT

The lighting apparatus has a wire box, a driver module, a light source and a light housing. The wire box is made of a heat dissipation material. The wire box is for placing a portion of an external wire. The driver module electrically connects to an electrode of the portion of the external wire. The light housing has a top cover and a surrounding wall. The top cover and the surrounding wall form a container space. The top cover has an inner side and an exterior side. The light source is thermally and structurally connected to the inner side for emitting a light via a light opening of the container space. The wire box is connected to the top cover of the light housing. Heat of the light source is transmitted to the wire box for heat dissipation via the back cover.

13 Claims, 14 Drawing Sheets

(56) References Cited

U.S. PATENT DOCUMENTS

| | | | | |
|---|---|---|---|---|
| 2013/0294084 | A1* | 11/2013 | Kathawate | F21V 29/70 362/294 |
| 2016/0025285 | A1* | 1/2016 | Johnson | F21V 13/02 362/294 |
| 2017/0339772 | A1* | 11/2017 | Ozaki | H05B 45/00 |

* cited by examiner

LIGHTING APPARATUS

FIELD

The present application is related to a lighting apparatus and more particularly related to a lighting apparatus with nice heat dissipation capability.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

SUMMARY

A lighting apparatus is provided. The lighting apparatus has a wire box, a driver module, a light source and a light housing. The wire box is made of a heat dissipation material. The wire box is for placing a portion of an external wire. The driver module electrically connects to an electrode of the portion of the external wire. The light housing has a top cover and a surrounding wall. The top cover and the surrounding wall form a container space. The top cover has an inner side and an exterior side. The light source is thermally and structurally connected to the inner side for emitting a light via a light opening of the container space. The wire box is connected to the top cover of the light housing. Heat of the light source is transmitted to the wire box for heat dissipation via the back cover.

In some embodiments, the exterior side of the top cover is connected to a bottom cover of the wiring box. The light source has a light source plate. The light source plate is mounted with multiple LED chips. Heat of the LED chips is transmitted to the light source plate, the top cover and the bottom cover of the wiring box.

In some embodiments, the wiring box has a connector. The connector elastically connects two side wings. The two side wings define an expandable diameter for inserting into an installation. The two side wings keep the lighting apparatus to the installation cavity.

In some embodiments, the two side wings are elastic levers with a central spring. The central spring is connected to the wiring box.

In some embodiments, the wiring box has a U-shaped structure. The U-shaped structure is connected to the side wings with a spring.

In some embodiments, the side wings are made of a heat dissipation material. The side wings bring heat of the wiring box to an installation box of the installation cavity.

In some embodiments, the side wings are heat conducted to the wiring box.

In some embodiments, there is an antenna. The antenna is disposed on the side wings. The antenna is electrically connected to a wireless circuit of the driver.

In some embodiments, the wiring box has multiple installation slots. The installation slots are for installing multiple slot modules. The driver is one of the slot modules.

In some embodiments, the driver has a main module. The main module is selectively integrated with selected function modules. The function module is one of the slot modules.

In some embodiments, the driver has a box housing and a driver circuit. The driver circuit is enclosed in the box housing. The box housing has a side. The side is attached to an inner wall of the wiring box.

In some embodiments, the box housing is attached to a top side of the wiring box and is away from the light housing.

In some embodiments, the wiring box has a conductive path. When the driver is installed to the wiring box, the driver uses the conductive path for electrically connecting to the external wire and the light source.

In some embodiments, the wiring box is a metal box.

In some embodiments, the wiring box has a fan and a gas exit. The fan and the gas exit move away heat in the wiring box.

In some embodiments, the fan is selectively inserted to the wiring box. The driver provides the fan current to drive the fan.

In some embodiments, the wiring box has a plugged interface. The plugged interface connects the external wire.

In some embodiments, the plugged interface is an IDEAL socket.

In some embodiments, the wiring box has multiple fins. The fins are folded from a surface of the wiring box. The fins form multiple corresponding openings.

In some embodiments, there is a connection part between the lighting housing and the bottom cover of the wiring housing. The connection part is filled with heat dissipation gel.

In some embodiments, the exterior side of the top cover of the light housing is connected to a bottom cover of the wiring box, the light source includes a light source plate mounted with multiple LED chips, heat of the LED chips is transmitted to the light source plate, the top cover of the light housing and the bottom cover of the wiring box.

In some embodiments, where the wiring box has a connector for elastically connecting two side wings, the two side wings defining an expandable diameter for inserting into an installation cavity and keeping the lighting apparatus to the installation cavity.

In some embodiments, the two side wings are elastic levers with a central spring connected to the wiring box.

In some embodiments, the wiring box has a U shape structure connected to the side wing with a spring.

In some embodiments, the side wings are heat conducted to the wiring box.

In some embodiments, an antenna is disposed on the side wings, the antenna is electrically connected to a wireless circuit of the driver.

In some embodiments, the wiring box has multiple installation slots for installing multiple slot modules, the driver is made as one slot module.

In some embodiments, the driver has a main module selectively integrated with selected function modules, the function module is made as one slot module.

In some embodiments, the driver has a box housing and a driver circuit, the driver circuit is enclosed in the box housing, the box housing has a side attached to an inner wall of the wiring box.

In some embodiments, the box housing is attached to a top side of the wiring box away from the light housing.

In some embodiments, wiring box has a conductive path, when the driver is installed to the wiring box, the driver is plugged to the wiring box and uses the conductive path for electrically connecting to external wire and the light source.

In some embodiments, the wiring box is a metal box.

In some embodiments, the wiring box has a fan and a gas exit for moving away heat in the wiring box.

In some embodiments, the fan is selectively inserted to the wiring box, the driver provides a fan current to drive the fan.

In some embodiments, the wiring box has a plugging interface for connecting the external wire.

In some embodiments, the plugging interface is an IDEAL socket.

In some embodiments, the wiring box has multiple fins folded from a surface of the wiring box forming multiple corresponding openings.

In some embodiments, a connection part between the lighting housing and the wiring box is filled with heat dissipation gel.

DETAILED DESCRIPTION

Figure 10:
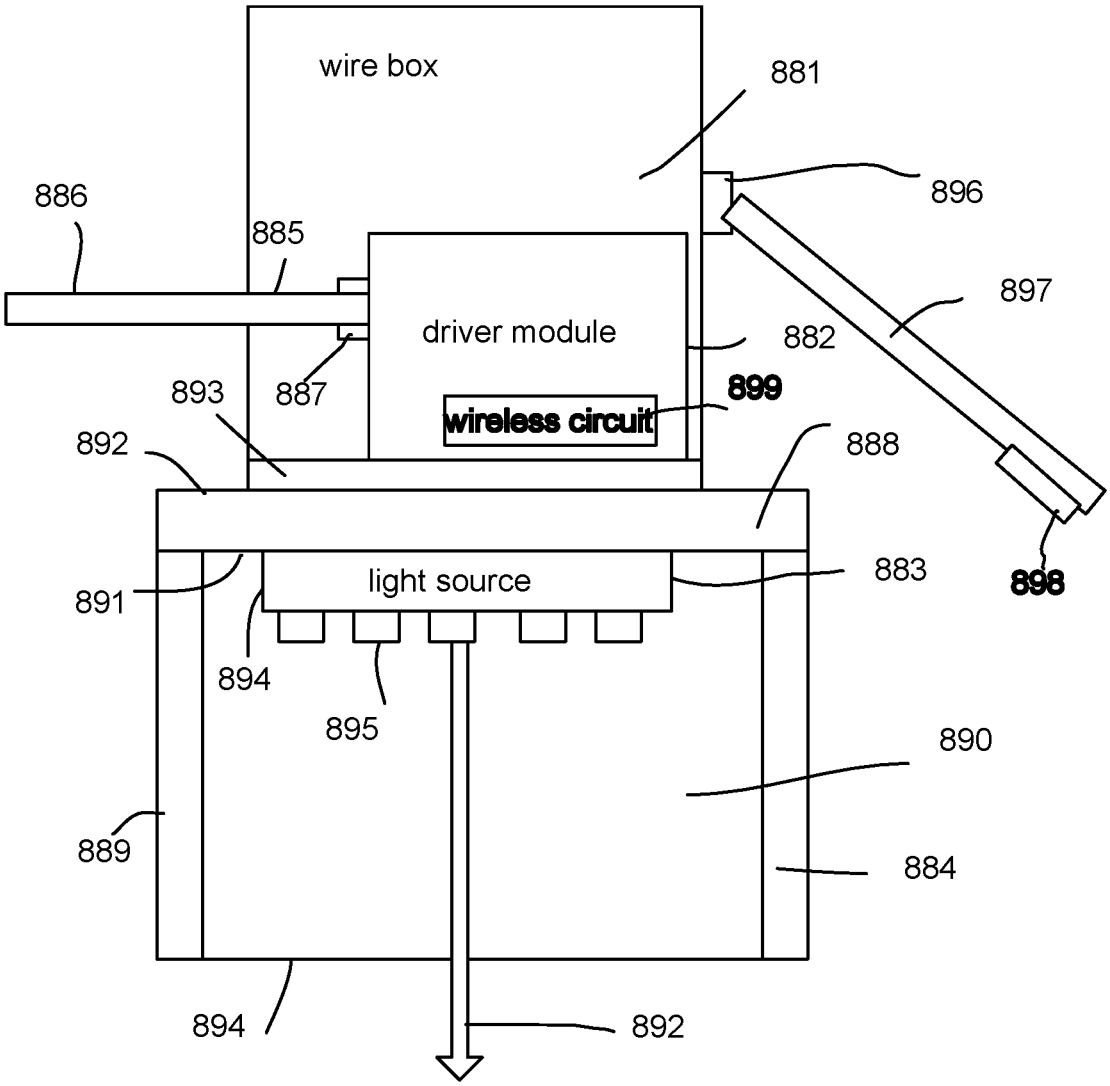
FIG. 10 illustrates a structure view of an embodiment.

In FIG. 10, a lighting apparatus is illustrated. The lighting apparatus has a wire box 881, a driver module 882, a light source 883 and a light housing 884. The wire box 881 is made of a heat dissipation material. The wire box 881 is for placing a portion 885 of an external wire 886. The driver module 882 electrically connects to an electrode 887 of the portion 885 of the external wire 886. The light housing 884 has a top cover 888 and a surrounding wall 889. The top cover 888 and the surrounding wall 889 form a container space 890. The top cover 888 has an inner side 891 and an exterior side 892. The light source 883 is thermally and structurally connected to the inner side 891 for emitting a light 892 via a light opening 894 of the container space 890. The wire box 881 is connected to the top cover 888 of the light housing 884. Heat of the light source 883 is transmitted to the wire box 881 for heat dissipation via the back cover 888.

In FIG. 10, the exterior side 892 of the top cover 888 is connected to a bottom cover 893 of the wiring box 881. The light source 883 has a light source plate 894. The light source plate 894 is mounted with multiple LED chips 895. Heat of the LED chips 895 is transmitted to the light source plate 894, the top cover 888 and the bottom cover 893 of the wiring box 881.

In FIG. 10, the wiring box 881 has a connector 896. In some embodiments, there are two connectors 896 (only one is shown) elastically connects two side wings 897 (only one is shown).

Figure 11A:
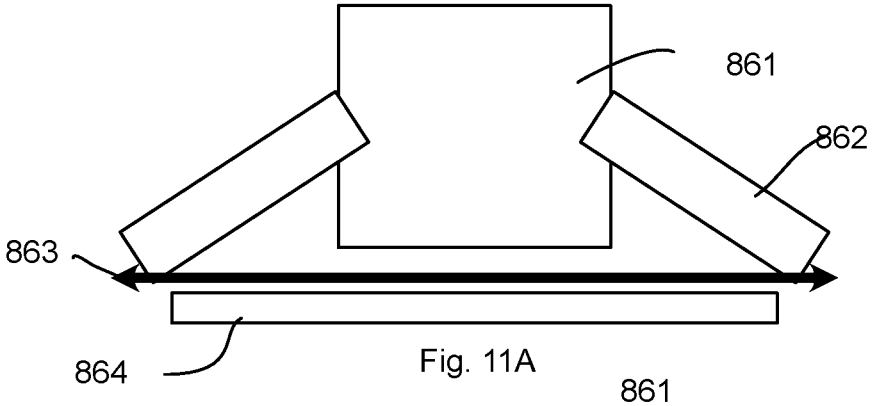
FIG. 11A, FIG. 11B, FIG. 11C and FIG. 11D show an operation of an embodiment.
Figure 11B:
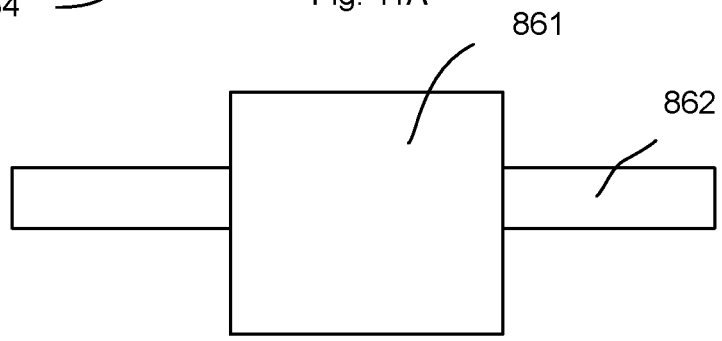
Figure 11C:
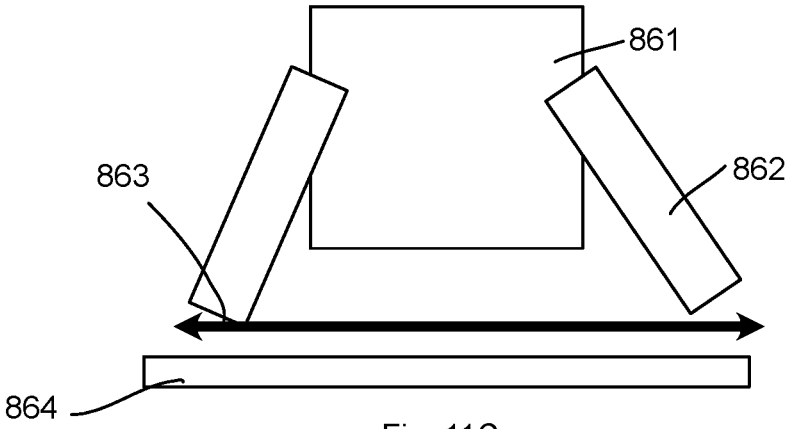
Figure 11D:
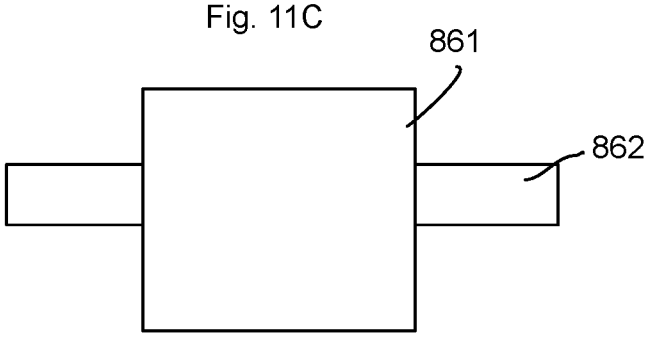

FIG. 11A and FIG. 11B show a first status of an embodiment, showing different views. In FIG. 11A and FIG. 11B, the two side wings 862 define an expandable diameter 863 for inserting into an opening 864 of an installation cavity. The two side wings 862 keep the lighting apparatus to the installation cavity. FIG. 11C and FIG. 11D show another status of the example of FIG. 11A and FIG. 11B with different views, where the expandable diameter 864 is smaller than the width of the opening 864 of the installation opening.

Figure 12:
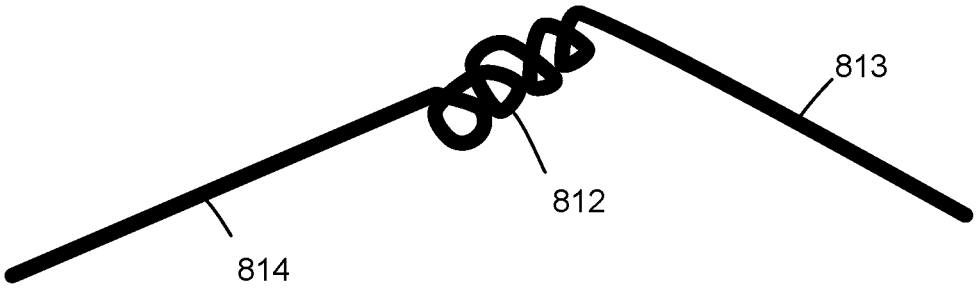
FIG. 12 shows a spring example.

In FIG. 12, the two side wings are elastic levers 813, 814 with a central spring 812. The central spring 812 is connected to the wiring box.

Figure 3:
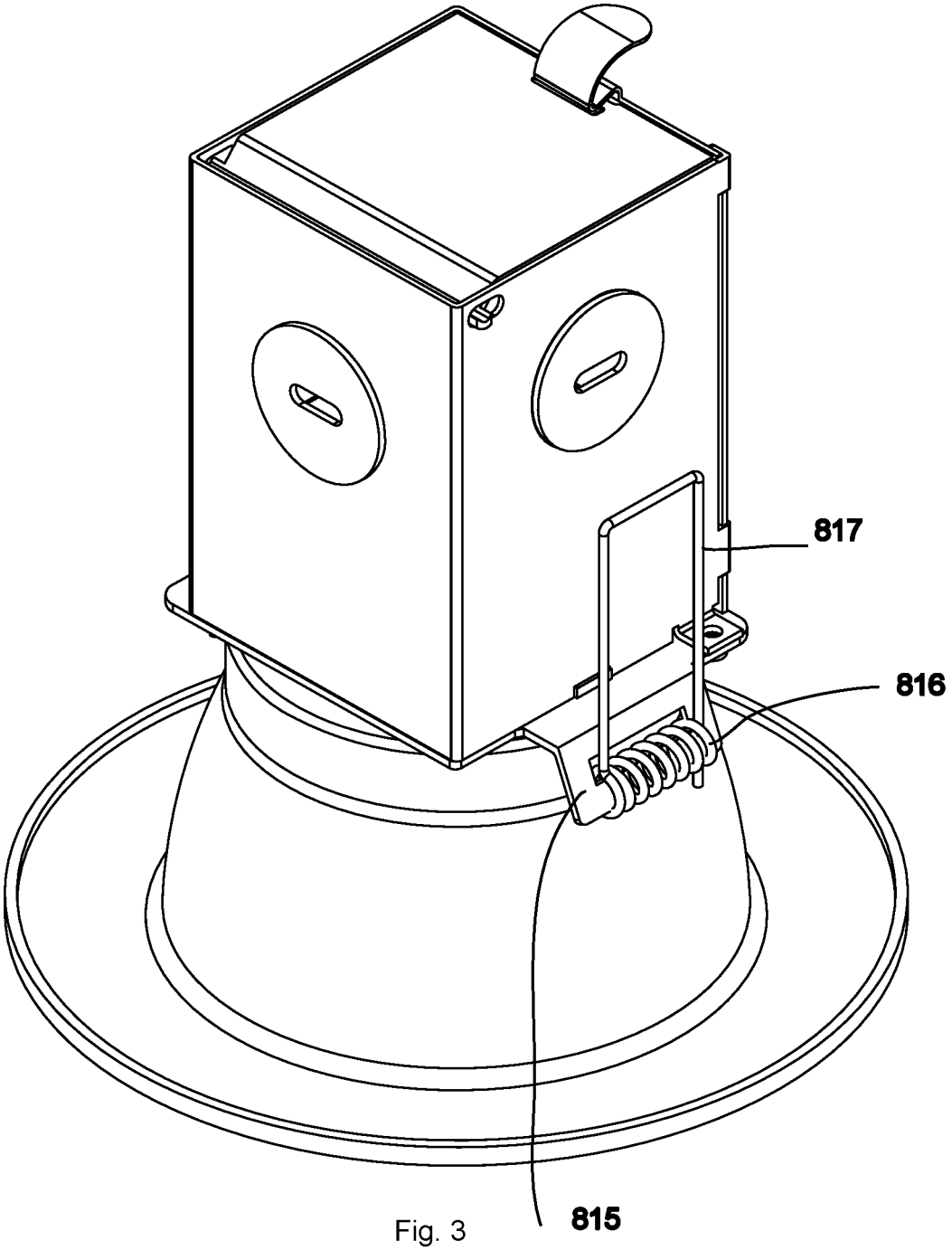
FIG. 3 shows another view of the embodiment in FIG. 1.
Figure 4:
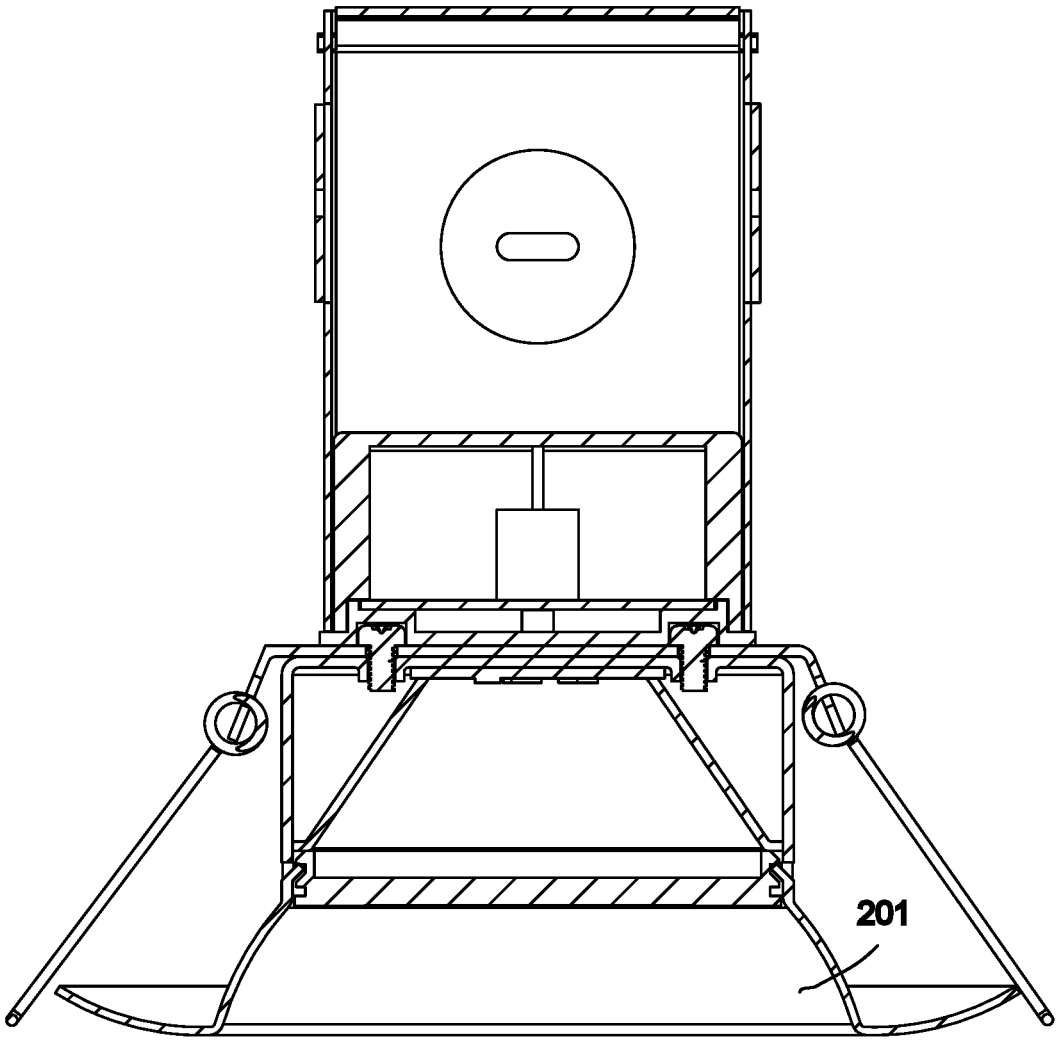
FIG. 4 shows another embodiment.
Figure 5:
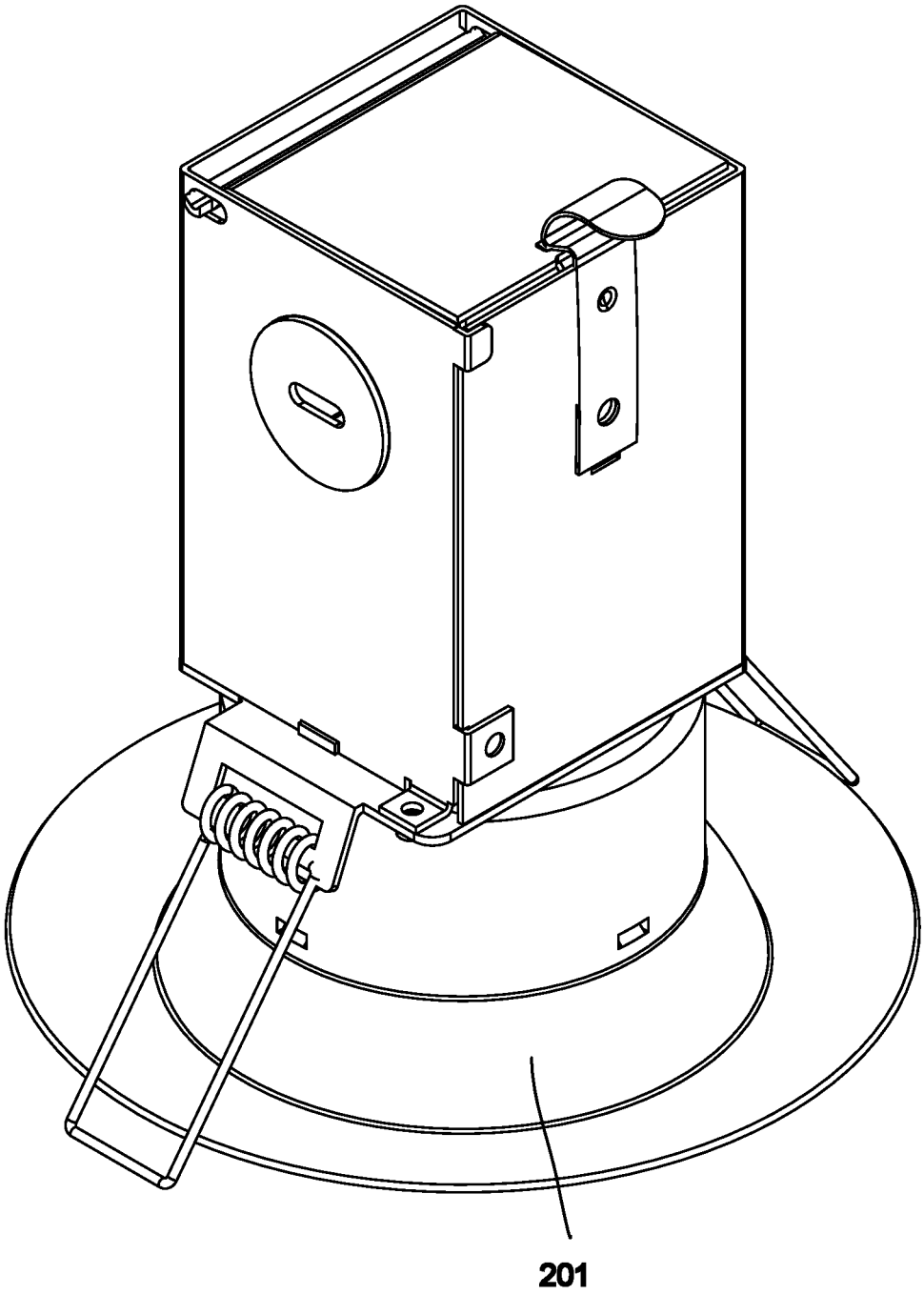
FIG. 5 shows another view of another embodiment.
Figure 6:
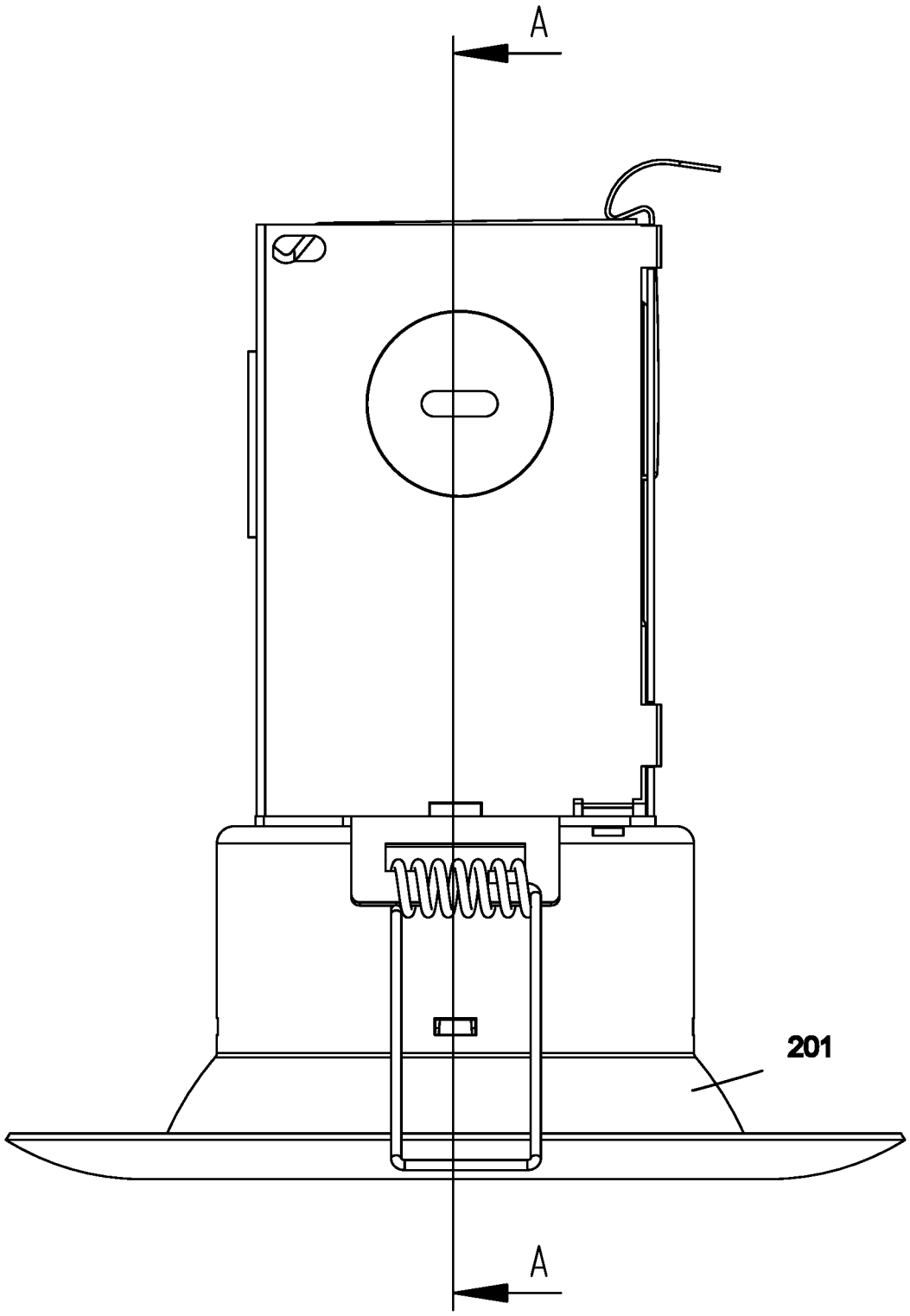
FIG. 6 shows another view of another embodiment.
Figure 7:
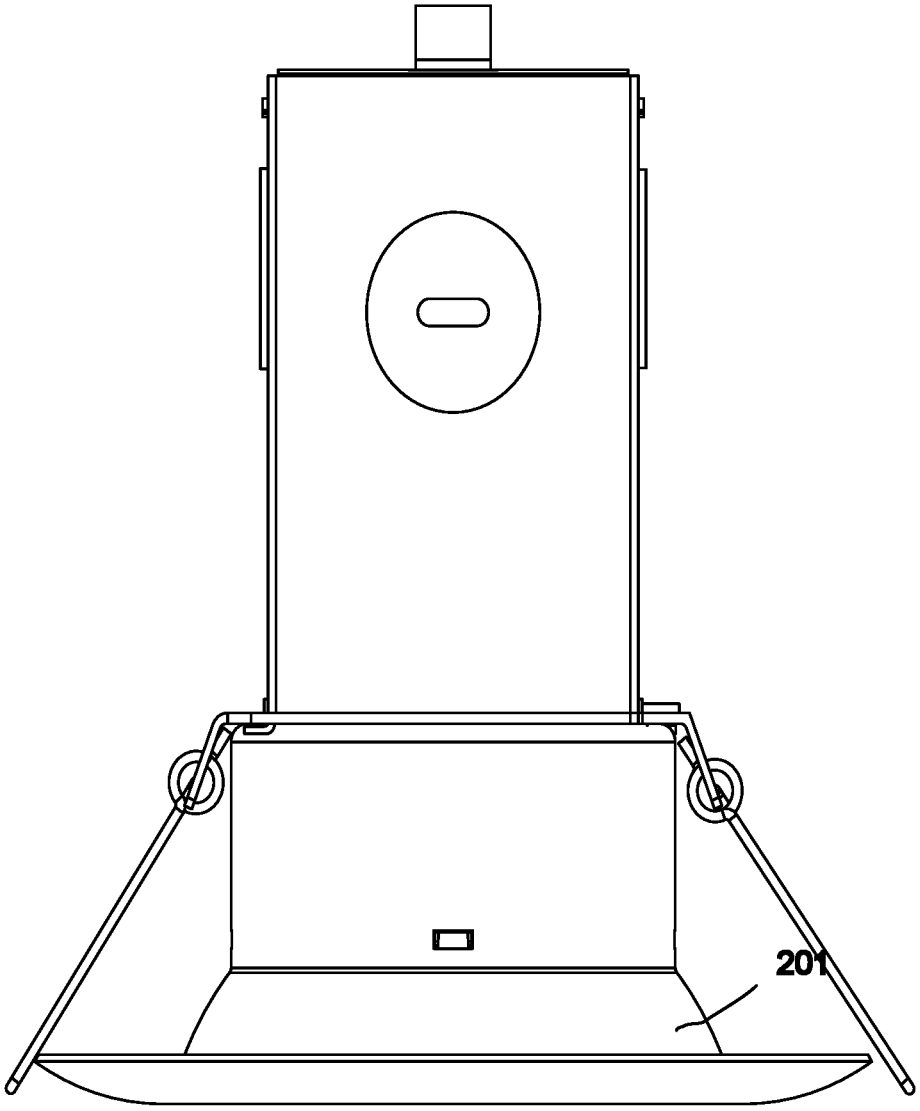
FIG. 7 another view of another embodiment.

In FIG. 3, the wiring box has a U-shaped structure 815. The U-shaped structure 815 is connected to the side wings 817 with a spring 816.

In some embodiments, the side wings are made of a heat dissipation material. The side wings bring heat of the wiring box to an installation box of the installation cavity.

In some embodiments, the side wings are heat conducted to the wiring box.

In FIG. 10, there is an antenna 898. The antenna 898 is disposed on the side wings 897. The antenna 898 is electrically connected to a wireless circuit 899 of the driver module 882.

Figure 13:
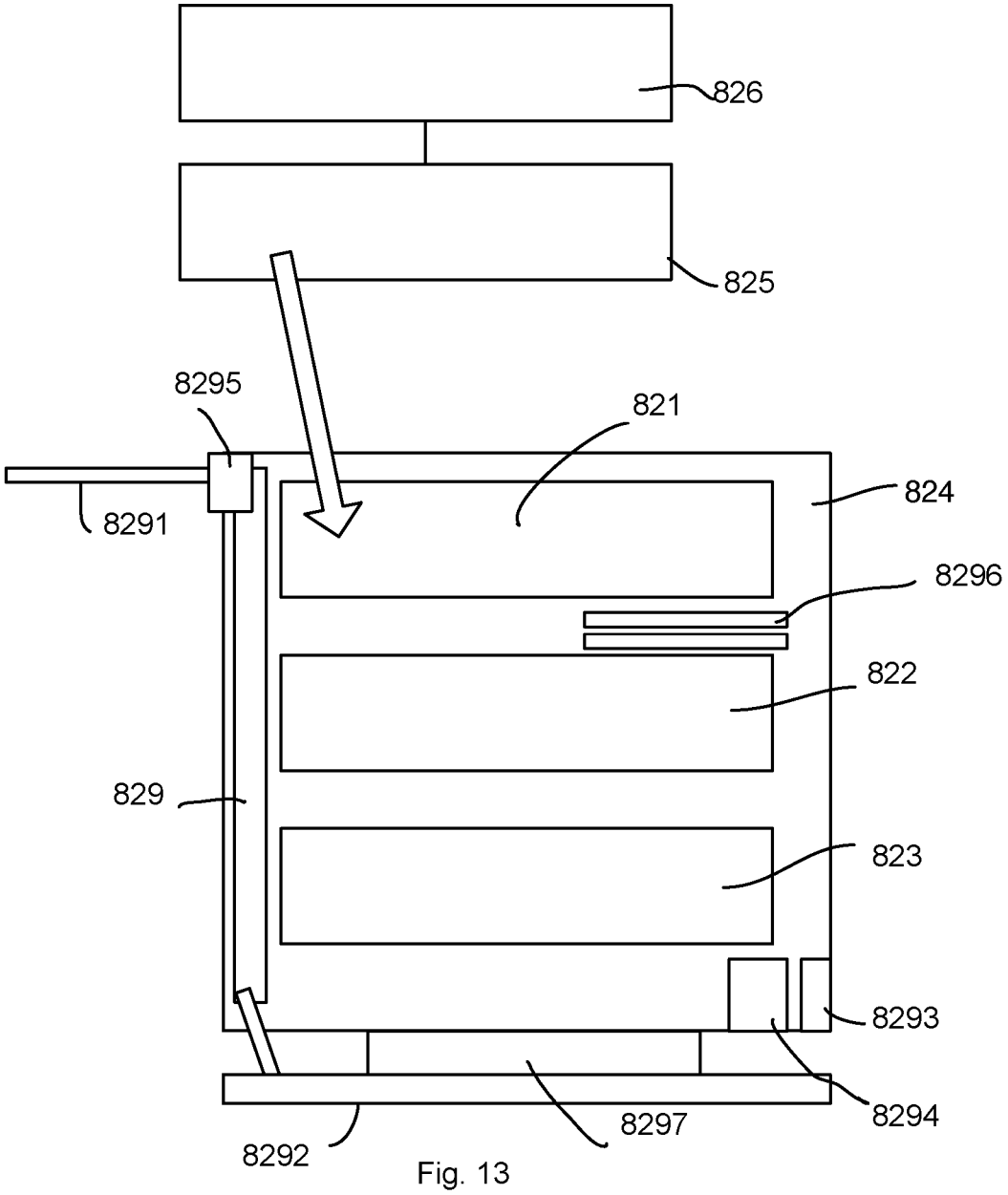
FIG. 13 shows a wiring box example.

In FIG. 13, the wiring box 824 has multiple installation slots 821, 822, 823. The installation slots 821, 822, 823 are for installing multiple slot modules like the slot module 825. The driver may be one of the slot modules. The wiring box 824 may provide some tracks or grooves for inserting such slot modules.

In FIG. 13, the driver has a main module like the slot module 825. The main module is selectively integrated with selected function modules like the module 826. The function module is one of the slot modules. For example, the driver has a main module. When necessary, the connected function module may be another power circuit module for providing more power to expanding light sources. Another example is that the connected function module provides wireless function for the driver.

Figure 14:
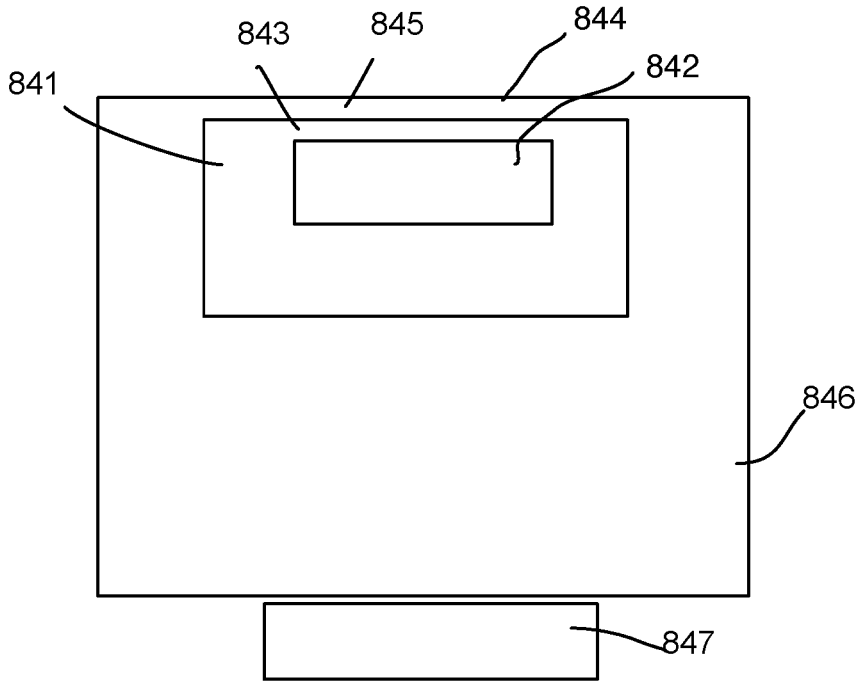
FIG. 14 shows another wiring box example.

In FIG. 14, the driver has a box housing 841 and a driver circuit 842. The driver circuit 842 is enclosed in the box housing 841. The box housing 841 has a side 843. The side 843 is attached to an inner wall 845 of the wiring box 846.

In FIG. 14, the box housing 841 is attached to a top side 844 of the wiring box 846 and is away from the light housing 847.

In FIG. 13, the wiring box 824 has a conductive path 829. When the driver is installed to the wiring box 824, the driver uses the conductive path 829 for electrically connecting to the external wire 8291 and the light source 8292.

In some embodiments, the wiring box is a metal box.

In FIG. 13, the wiring box has a fan 8294 and a gas exit 8293. The fan 8924 and the gas exit 8293 move away heat in the wiring box.

In some embodiments, the fan is selectively inserted to the wiring box. The driver provides the fan current to drive the fan. For example, the conductive path mentioned above maybe used for transferring electricity and the module design may be used for designing the fan.

In FIG. 13, the wiring box has a plugged interface 8295. The plugged interface 8295 connects the external wire 8291.

In some embodiments, the plugged interface is an IDEAL socket.

In FIG. 13, the wiring box has multiple fins 8296. The fins 8296 are folded from a surface of the wiring box 824. The fins 8296 form multiple corresponding openings.

In FIG. 13, there is a connection part 8297 between the lighting housing and the bottom cover of the wiring housing. The connection part 8297 is filled with heat dissipation gel.

Figure 1:
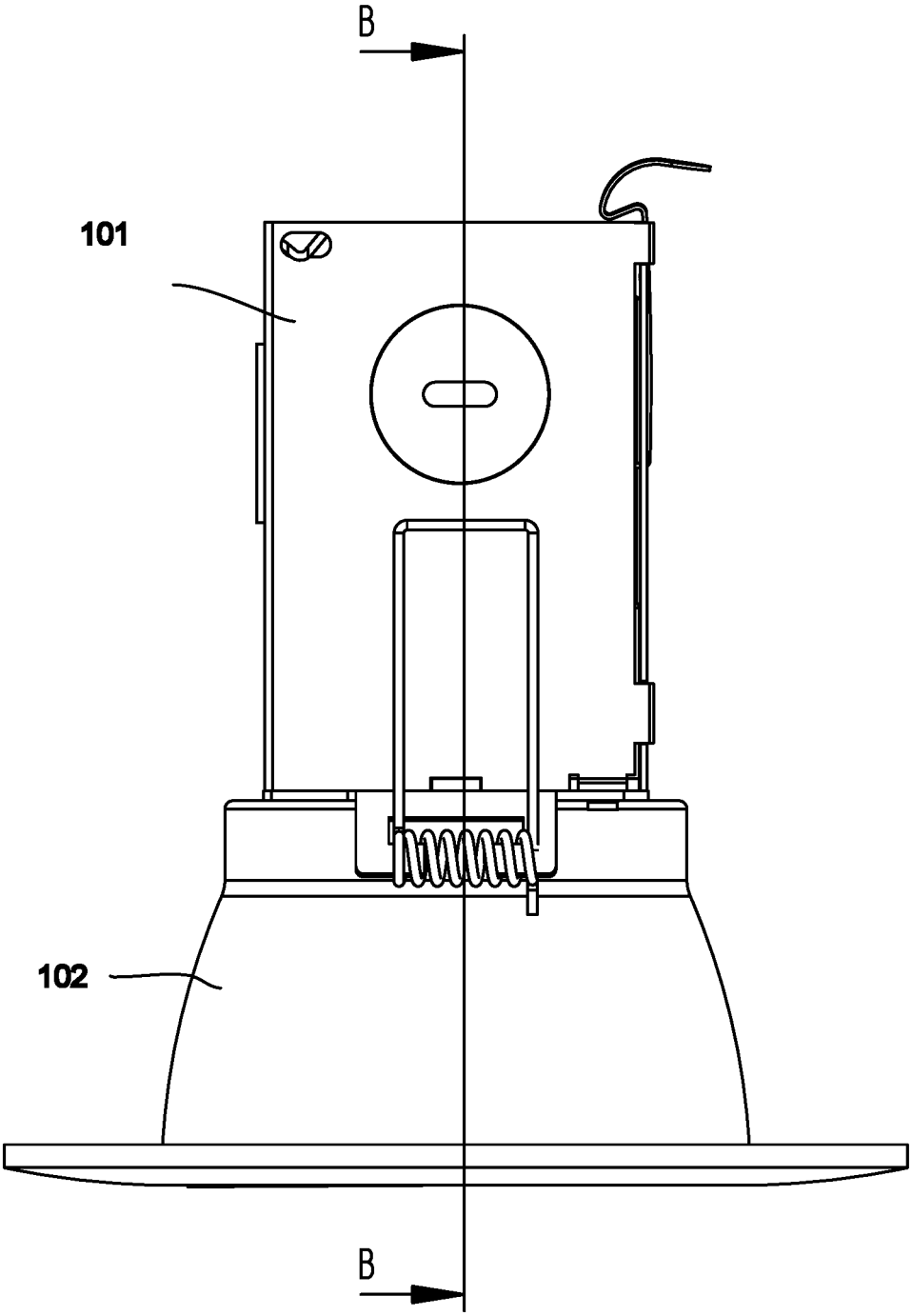
FIG. 1 shows a side of a lighting apparatus embodiment.
Figure 2:
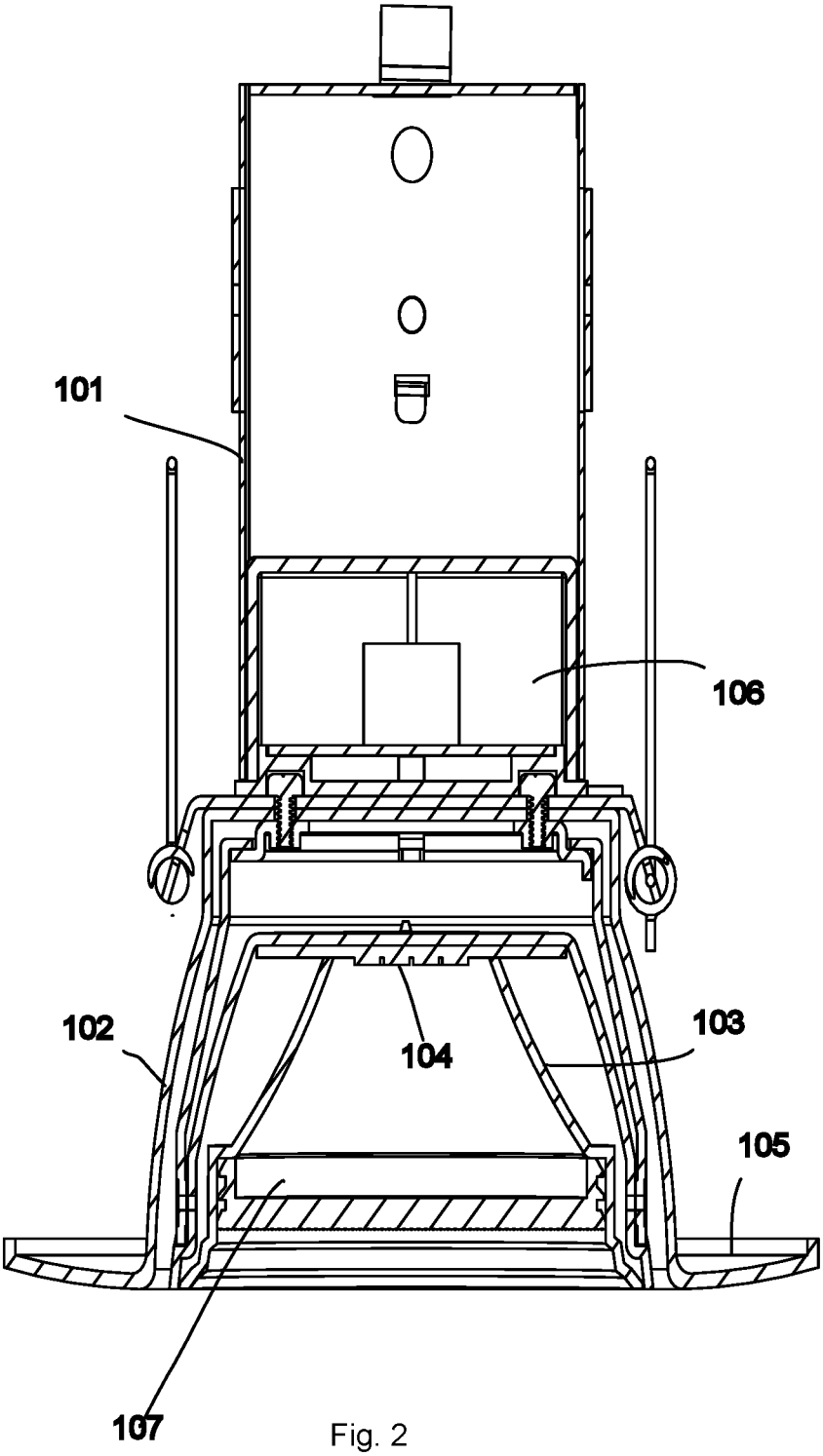
FIG. 2 shows a cross section view of the embodiment in FIG. 1.

Please refer to FIG. 1 and FIG. 2, which illustrate an embodiment. In FIG. 1 and FIG. 2. The lighting apparatus includes a wiring box 101 and a light body 102. A driver 106 is placed inside the wiring box 101. The light body 102 has a light source 104, a reflector 103, a lens 107 and a surface rim 105.

FIG. 3 illustrate another view of the embodiment in FIG. 1 and FIG. 2.

FIG. 4, FIG. 5, FIG. 6 and FIG. 7 show another embodiment with a different light body 201.

Figure 8:
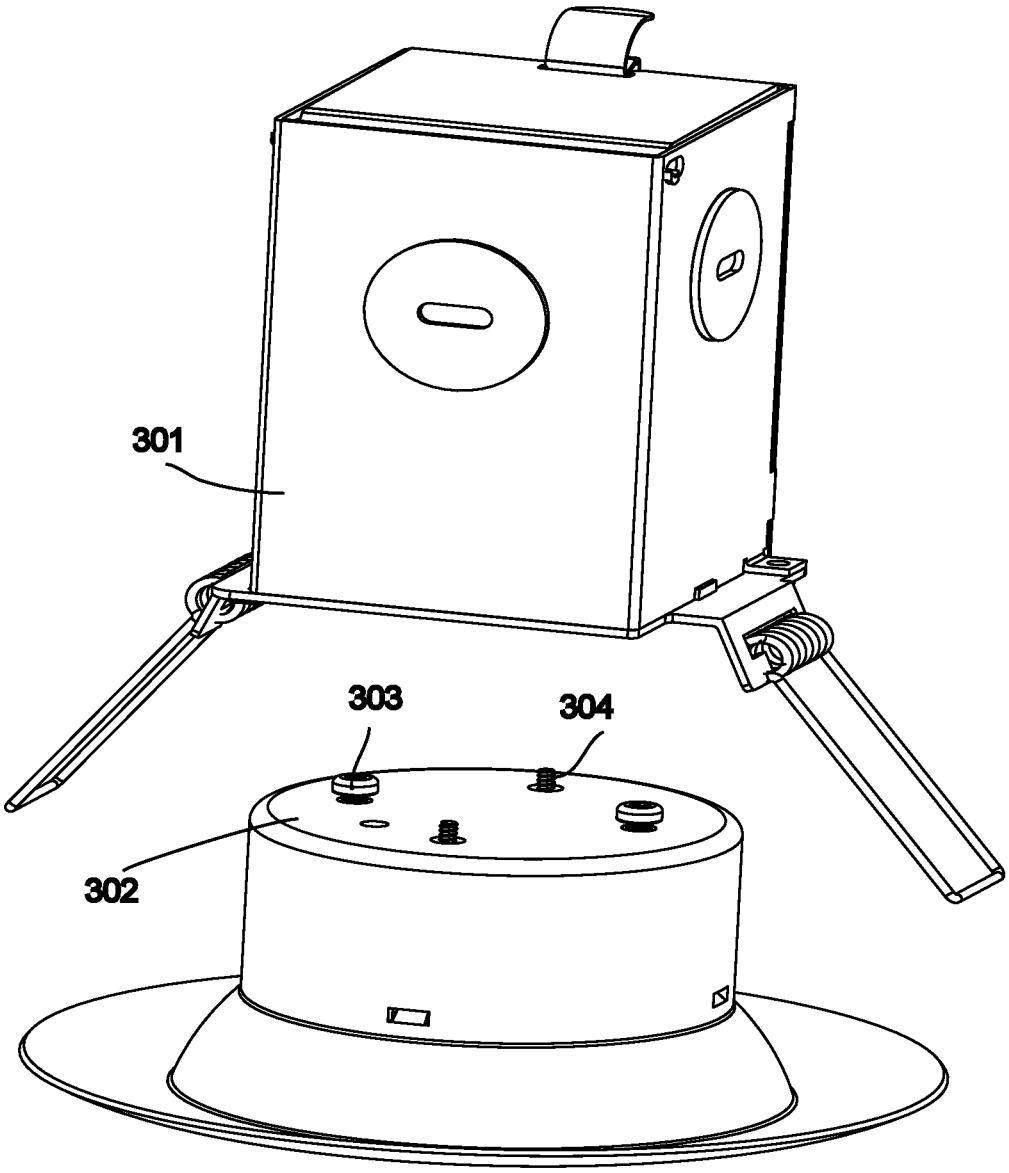
FIG. 8 shows a detachable design of two components.

FIG. 8 shows that the wiring box 301 is detachably removed from the light body 302. There are structural connectors 303 and electrical connectors 304 for connecting the light body 302 and the wiring box 301.

Figure 9:
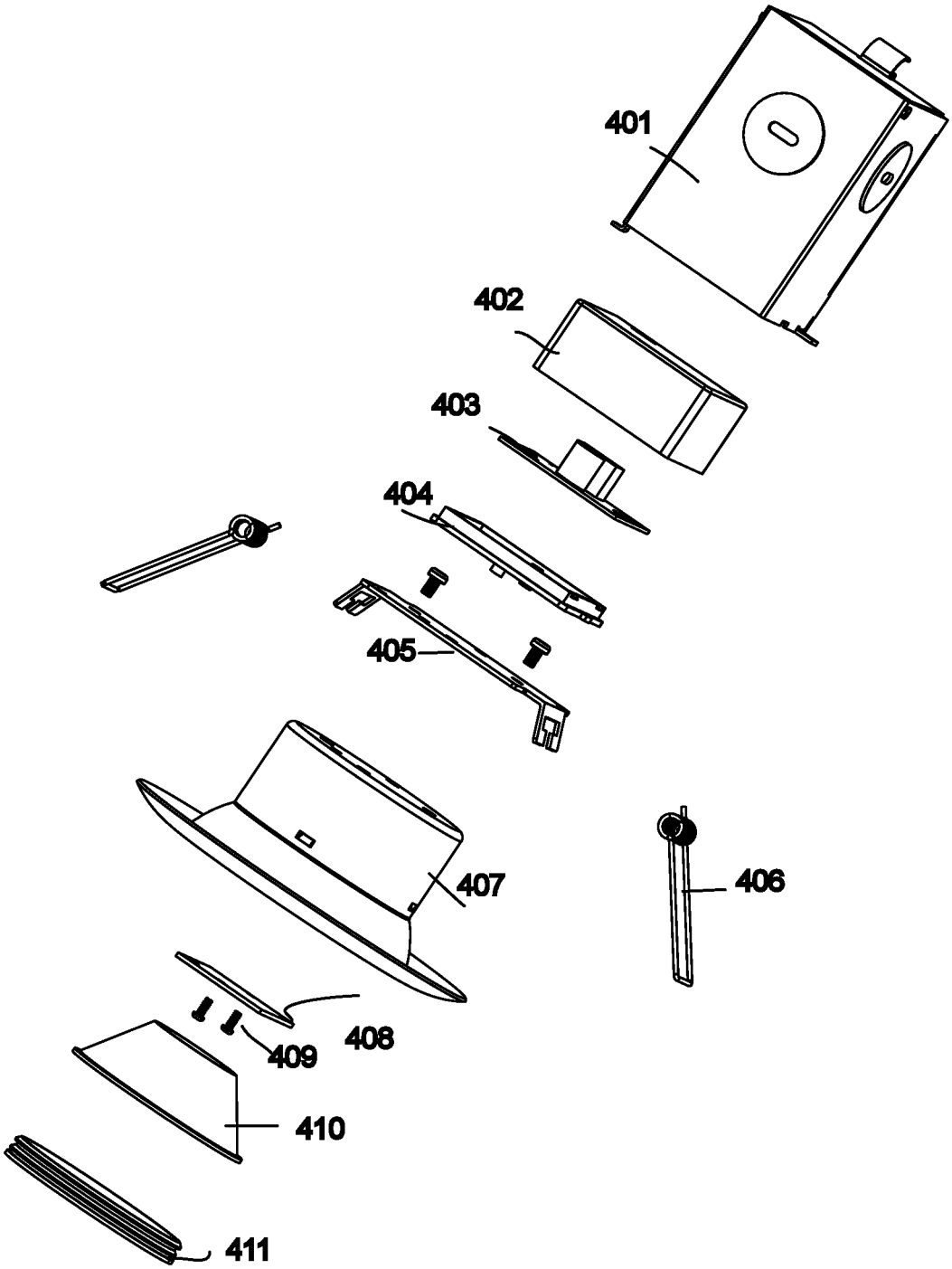
FIG. 9 shows an exploded view of an embodiment.

FIG. 9 shows an exploded diagram of an embodiment. In FIG. 9, the lighting apparatus has a wiring box 401. A driver box has a box housing 402 and a bottom cover 404 for containing a driver circuit 403. There is a connector 405 fixed to the wiring box 401 for connecting two elastic springs 406. A light housing 407 is attached to the wiring box 401. A light source 408 is placed inside the light housing 407. Two screws are used for fixing the light source 408 to the light housing 407 for transmitting heat to the wiring box 401. There is a reflector 410 and a diffusion cover 411 for producing desired light effect and improving light efficiency.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a wire box made of a heat dissipation material for placing a portion of an external wire;

a driver module for electrically connecting to an electrode of the portion of the external wire;

a light source; and a light housing having a top cover and a surrounding wall forming a container space, the top cover having an inner side and an exterior side, the light source being thermally and structurally connected to the inner side for emitting a light via a light opening of the container space, the wire box being connected to the top cover of the light housing, heat of the light source being transmitted to the wire box for heat dissipation via the back cover, wherein the wiring box has a connector for elastically connecting two side wings, the two side wings are levers defining an expandable diameter for inserting into an installation cavity and keeping the lighting apparatus to the installation cavity, wherein an antenna is disposed on the side wings, the antenna is electrically connected to a wireless circuit of the driver, wherein the wiring box has multiple installation slots for installing multiple slot modules, the driver is made as one slot module, wherein the driver has a main module selectively integrated with selected function modules, the function module is made as one slot module, wherein wiring box has a conductive path, when the driver is installed to the wiring box, the driver is plugged to the wiring box and uses the conductive path for electrically connecting to external wire and the light source.

2. The lighting apparatus of claim 1, wherein the exterior side of the top cover of the light housing is connected to a bottom cover of the wiring box, the light source comprises a light source plate mounted with multiple LED chips, heat of the LED chips is transmitted to the light source plate, the top cover of the light housing and the bottom cover of the wiring box.

3. The lighting apparatus of claim 1, wherein the two side wings are elastic levers with a central spring connected to the wiring box.

4. The lighting apparatus of claim 1, wherein the wiring box has a U shape structure connected to the side wing with a spring.

5. The lighting apparatus of claim 1, wherein the side wings are heat conducted to the wiring box.

6. The lighting apparatus of claim 1, wherein the driver has a box housing and a driver circuit, the driver circuit is enclosed in the box housing, the box housing has a side attached to an inner wall of the wiring box.

7. The lighting apparatus of claim 6, wherein the box housing is attached to a top side of the wiring box away from the light housing.

8. The lighting apparatus of claim 1, wherein the wiring box is a metal box.

9. The lighting apparatus of claim 1, wherein the wiring box has a fan and a gas exit for moving away heat in the wiring box.

10. The lighting apparatus of claim 9, wherein the fan is selectively inserted to the wiring box, the driver provides a fan current to drive the fan.

11. The lighting apparatus of claim 1, wherein the wiring box has a plugging interface for connecting the external wire.

12. The lighting apparatus of claim 1, wherein the wiring box has multiple fins folded from a surface of the wiring box forming multiple corresponding openings.

13. The lighting apparatus of claim 1, wherein a connection part between the lighting housing and the wiring box is filled with heat dissipation gel.

* * * * *